US009771200B2

(12) United States Patent
Sun et al.

(10) Patent No.: US 9,771,200 B2
(45) Date of Patent: Sep. 26, 2017

(54) EASILY-OPERATED VACUUM STORAGE CONTAINER

(71) Applicant: Dongguan Pheaton Electronic Technology Co., Ltd., Dongguan (CN)

(72) Inventors: Yungming Sun, Dongguan (CN); Shunqing Ye, Dongguan (CN); Linwen Yang, Dongguan (CN); Lanhua Tian, Dongguan (CN)

(73) Assignee: DONGGUAN PHEATON ELECTRONIC TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 15/004,171

(22) Filed: Jan. 22, 2016

(65) Prior Publication Data

US 2017/0190495 A1 Jul. 6, 2017

(30) Foreign Application Priority Data

Dec. 31, 2015 (CN) ..... 2015 1 1014854

(51) Int. Cl.
*B65D 81/20* (2006.01)
*B65D 25/28* (2006.01)

(52) U.S. Cl.
CPC ..... *B65D 81/2038* (2013.01); *B65D 25/28* (2013.01)

(58) Field of Classification Search
CPC ..... B65D 1/04; B65D 25/28; B65D 39/00; B65D 43/02; B65D 51/16; B65D 51/18; B65D 53/02; B65D 81/20; B65D 81/2015; B65D 81/2038; B65D 81/34; B65D 86/36; B65D 43/0233; B65D 45/16; B65D 81/24
USPC ..... 206/524.8; 99/468, 472, 476; 141/8, 65, 141/197, 325, 326; 220/202, 220/203.1–203.29, 212, 231, 367.1
See application file for complete search history.

(56) References Cited

U.S. PATENT DOCUMENTS 5,405,038 A * 4/1995 Chuang ..... B65B 31/047 141/65
6,644,489 B2 * 11/2003 Chang ..... B65D 81/2038 220/203.01
7,721,771 B2 * 5/2010 Tsay ..... B01J 3/006 141/65
7,726,505 B2 * 6/2010 Cheung ..... F16K 17/28 220/231
8,113,246 B2 * 2/2012 Hsieh ..... A47J 47/10 141/197

(Continued)

*Primary Examiner* — Bryon Gehman
(74) *Attorney, Agent, or Firm* — Ming Chow; Sinorica, LLC

(57) ABSTRACT

An easily-operated vacuum storage container comprises box body and a vacuum control device that is mounted on the box body in a removable manner. The vacuum control device comprises a vacuum pump for evacuating the box body that is provided with a vacuum relief valve, and a relief valve control mechanism. When the vacuum control device is mounted in the box body, the relief valve control mechanism can open or close the vacuum relief valve. When the vacuum control device is not mounted in the box body, users can directly control the vacuum relief valve to release the vacuum inside the box body. When the vacuum control device is mounted and users need to release the vacuum in the box body, they need not to take up the vacuum control device, but directly operate the relief valve control mechanism on the vacuum control device to release the vacuum.

8 Claims, 7 Drawing Sheets

(56) References Cited

U.S. PATENT DOCUMENTS

| | | | | |
|---|---|---|---|---|
| 8,936,169 | B2 * | 1/2015 | Lui | B65D 81/20 206/524.8 |
| 9,676,526 | B2 * | 6/2017 | Gonsalves | B65D 43/0233 |
| 2006/0231556 | A1 * | 10/2006 | Wei | B65B 31/047 220/203.18 |
| 2015/0136786 | A1 * | 5/2015 | Lonner | B65D 45/16 220/529 |
| 2017/0036842 | A1 * | 2/2017 | Lonner | B65D 45/16 |
| 2017/0174411 | A1 * | 6/2017 | Lonner | B65D 81/24 |

* cited by examiner

EASILY-OPERATED VACUUM STORAGE CONTAINER

The current application claims a foreign priority to application number 201511014854.6 filed on Dec. 31, 2015 in China.

FIELD OF THE INVENTION

The invention relates to the technical field of storage containers, and in particular, to an easily-operated vacuum storage container.

BACKGROUND OF THE INVENTION

In order to store foods and other perishable articles, a vacuum way is used in many storage containers to delay the oxidative deterioration process of the articles and achieve the purpose of preservation.

China Patent (publication No.: CN 104925385A) disclosed a vacuum storage container, which can evacuate the air in the container to preserve the articles. In order to save costs, this kind of vacuum storage container adopts a way separating the vacuum pump and the box body; when a box body is vacuumized, the vacuum pump can be retained on the box body, to maintain a vacuum state; or the vacuum pump can be removed to evacuate other box body. The part used to release the vacuum state of the box body is a push-type vacuum relief valve; when the vacuum relief valve is pressed down, the vacuum relief valve and box body form an intake passage, and the outside air will enter the box body to release the vacuum state. The vacuum relief valve is arranged between the upper cover of the box body and the vacuum pump, and such a design can make the shell of the vacuum storage container flat and aesthetic, and can effectively prevent mistaken operations by the users. However, such design also has its shortcomings: when the vacuum state of the box body needs to be released, it is necessary to dismantle the vacuum pump firstly and then press the vacuum relief valve, to deform the vacuum relief valve and remove the sealed state, and the outside air enters into the box body to release the vacuum. With the above design, it is required to dismantle the vacuum pump for each time of operation, and it is complicated, inconvenient to use.

SUMMARY OF THE INVENTION

The object of the invention is to provide an easily-operated vacuum storage container, to facilitate users to release the vacuum state of the box body.

To resolve the above technical problems, the invention provides the following technical solutions:

An easily-operated vacuum storage container, comprising a box body and a vacuum control device that is mounted on the box body in a removable manner, the vacuum control device comprises a vacuum pump for evacuating the box body that is provided with a vacuum relief valve, wherein the vacuum control device also comprises a relief valve control mechanism; when the vacuum control device is mounted on the box body, the relief valve control mechanism can open or close the vacuum relief valve.

Wherein, the vacuum relief valve is push-type, the relief valve control mechanism includes a top column that can be controlled to move and press the vacuum relief valve.

Wherein, the relief valve control mechanism includes a handle that controls the movement of the top column, the handle is hinged to the vacuum control device; the handle drives the top column to move when pulled.

Wherein, the vacuum control device is provided with a groove that matches the shape of the handle, and the handle is placed in the groove.

Wherein, a driving mechanism is provided between the handle and the top column, when pulling the handle, the top column moves driven by the driving mechanism.

Wherein, the top column is connected with a reset spring to make the top column to reset when the handle is reset.

Wherein, the vacuum control device is provided with a control assembly, when the relief valve control mechanism opens the vacuum relief valve, the control assembly controls the vacuum pump to stop pumping.

Wherein, the control assembly is specifically a switch control structure provided on the relief valve control mechanism and a trigger switch connected to the circuit of the vacuum pump, when the relief valve control mechanism opens the vacuum relief valve, it drives the switch control structure to move, to trigger the trigger switch to disconnect the circuit of the vacuum pump.

Wherein, the vacuum relief valve is provided with a vacuumizing channel that is connected, the vacuumizing channel is provided with a check valve, when the vacuum control device is mounted to the box body, the vacuum pump is connected to the vacuumizing channel, the check valve opens when the vacuum pump is pumped.

Wherein, the relief valve control mechanism is provided with the top column used to open or close the vacuum relief valve, the top column is hollow to form an evacuation tube, when mounted in the box body, the vacuum control device is connected to the vacuum pump and the vacuumizing channel via the evacuation tube.

Compared to prior art, the present invention can achieve the following beneficial effects:

The invention provides an easily-operated vacuum storage container, comprising a box body and a vacuum control device that is mounted on the box body in a removable manner. The box body is provided with a vacuum relief valve. When the vacuum control device is not mounted in the box body, users can directly control the vacuum relief valve to release the vacuum inside the box body. When the vacuum control device is mounted and users need to release the vacuum in the box body, they need not to take up the vacuum control device, but directly operate the relief valve control mechanism on the vacuum control device to release the vacuum. Regardless of whether the vacuum control device is mounted or removed, the operation for releasing the vacuum state in the invention is easy, facilitating users to use them.

BRIEF DESCRIPTION OF THE DRAWINGS

The invention is further described with the drawings and embodiments, which do not constitute a restriction. In the drawings.

NOTES

1—box body, 11—vacuum relief valve, 111—check valve;

2—vacuum control device, 21—handle, 211—driving mechanism, 212—switch control structure, 22—top column, 221—spring, 222—through-hole, 23—trigger switch, 24—vacuum pump.

DETAILED DESCRIPTION OF THE EMBODIMENTS

The invention is further described with the drawings and preferred embodiments. It should be understood that, the preferred embodiments herein are only used for description and explanation of the invention instead of restriction on the invention.

Figure 1:
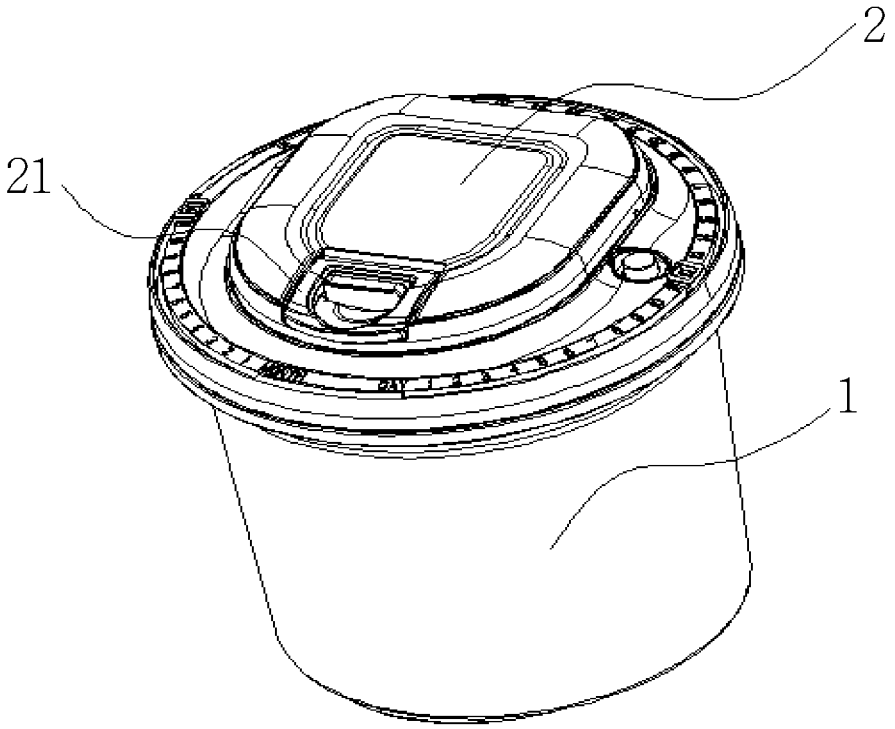
FIG. 1 is a schematic view of the overall structure of an easily-operated vacuum storage container.
Figure 2:
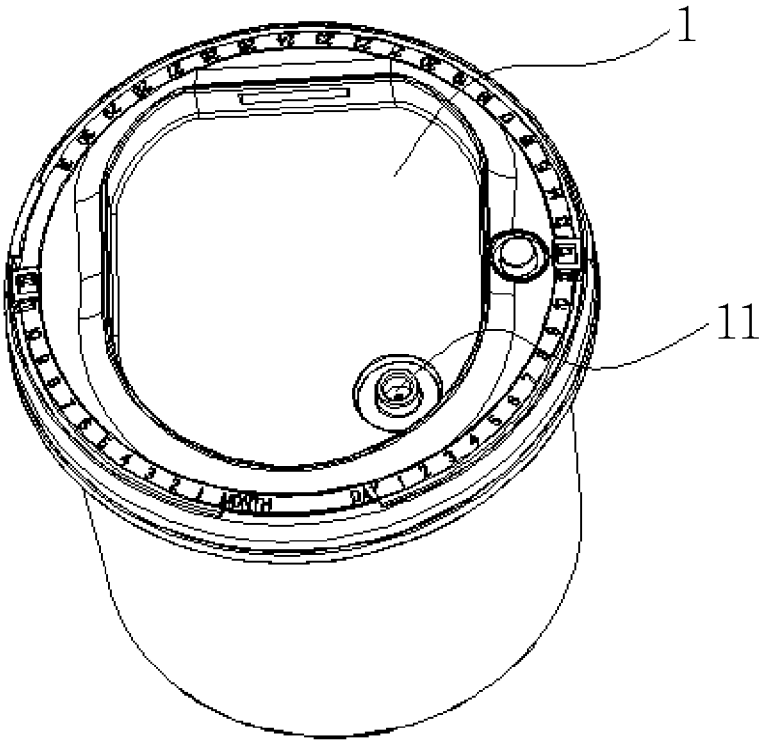
FIG. 2 is a schematic view of an easily-operated vacuum storage container without a vacuum control device.
Figure 3:
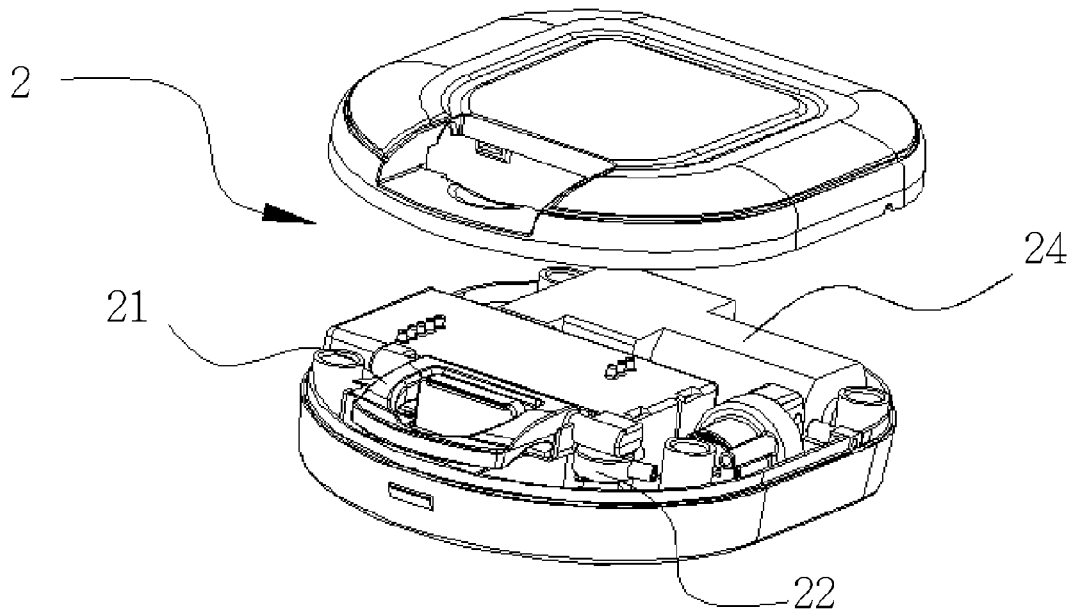
FIG. 3 is an inside schematic view of a vacuum control device.
Figure 4:
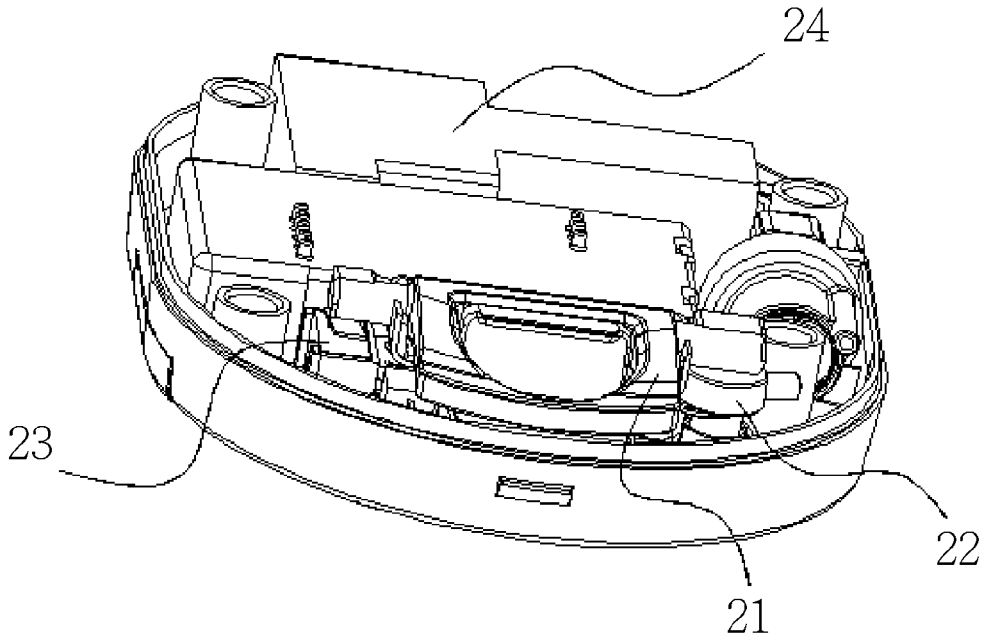
FIG. 4 is an inside schematic view of a vacuum control device from another angle.
Figure 5:
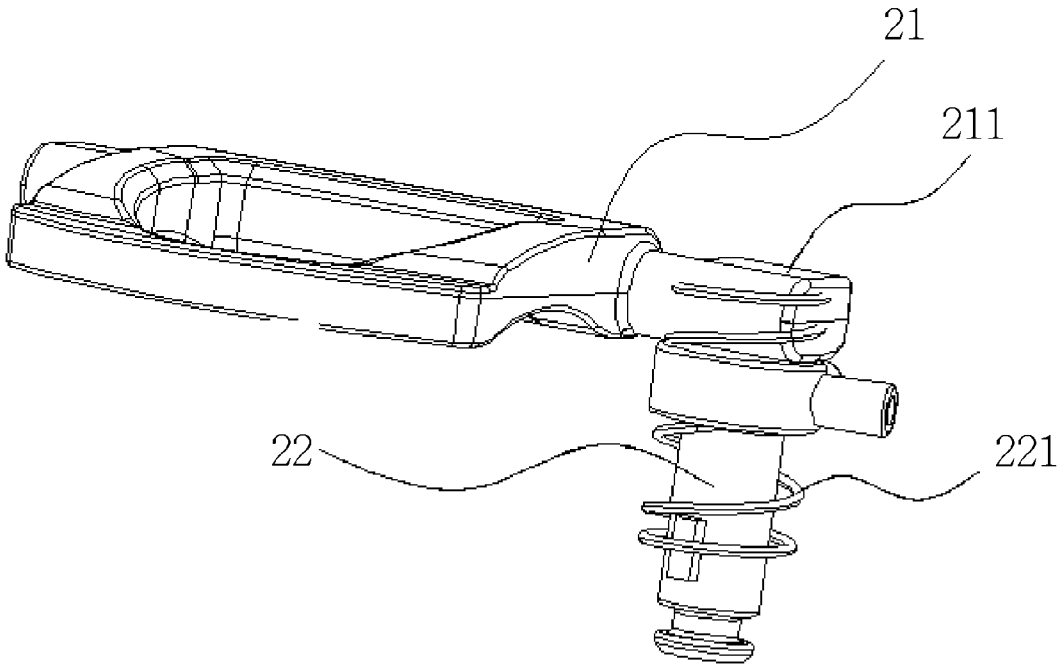
FIG. 5 is a schematic view of a relief valve control mechanism.
Figure 6:
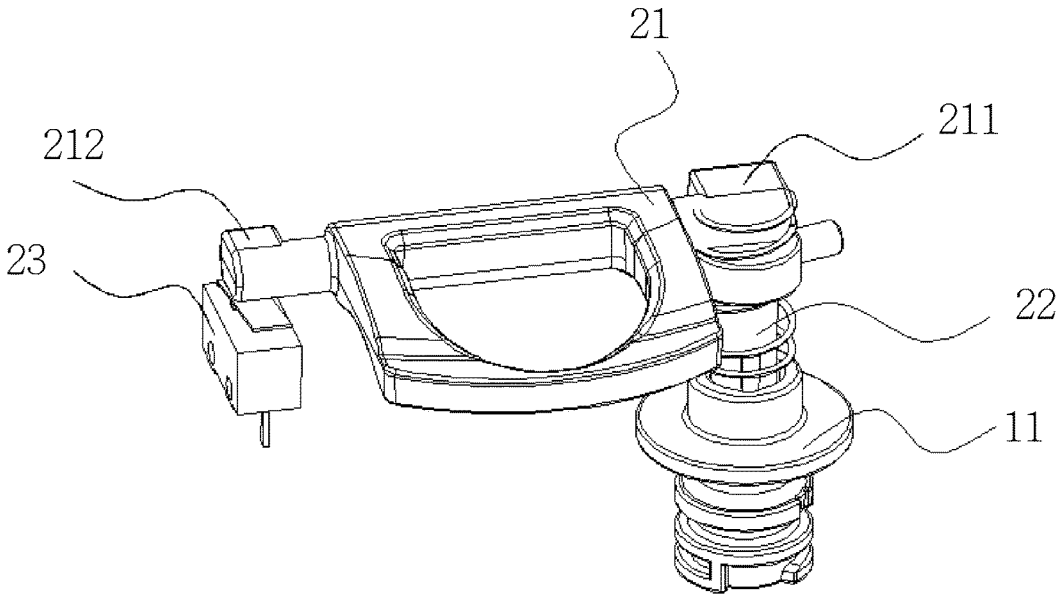
FIG. 6 is schematic view of a relief valve control mechanism combined with a vacuum relief valve and control assembly.
Figure 7:
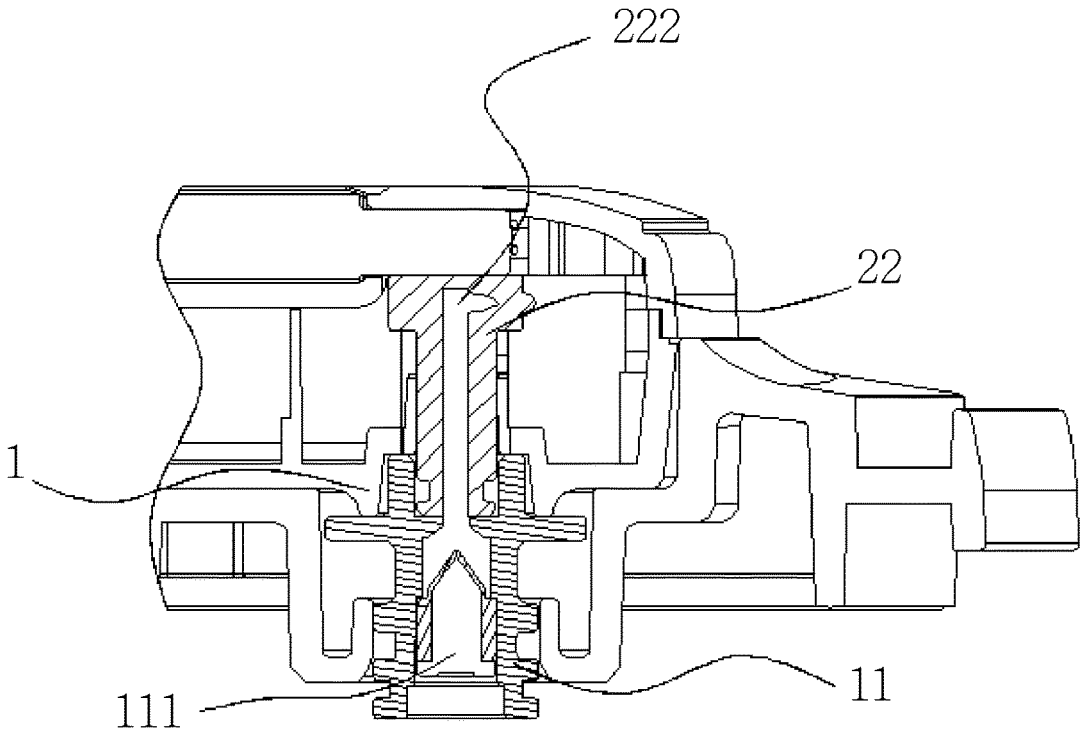
FIG. 7 is a cross-sectional view of the vacuum relief valve when installed in the box body.

Referring to FIG. 1 and FIG. 2, an easily-operated vacuum storage container comprising a box body 1 and a vacuum control device 2 that is mounted on the box body 1 in a removable manner; the box body 1 is provided with a vacuum relief valve 11, as shown in FIG. 3. A vacuum pump 24 is provided inside the vacuum control device 2 (not shown in the FIG.). Specifically, as shown in FIG. 2 and FIG. 7, the vacuum relief valve 11 is a push-type one, when the vacuum relief valve 11 is pressed, the vacuum relief valve 11 will be displaced. The vacuum relief valve 11 is used to block the air intake of the box body 1 and seal it, but when the vacuum relief valve 11 is pressed and displaced, the vacuum relief valve 11 will no seal the air intake of the box body 1, and form an air inlet channel, and the outside air can enter the box body 1. A through-hole is provided in the axial direction of the vacuum relief valve 11, which is the vacuumizing channel. The vacuumizing channel is provided with a check valve 111. When mounted on the box body 1, the vacuum control device 2 is connected to the vacuumizing channel, and the check valve 11 is opened when pumping by the vacuum pump 24, and when the vacuum control device 2 is not mounted or the vacuum pump 24 does not work, the check valve 111 can prevent air from entry into the box body 1. Referring to FIG. 3 and FIG. 4, the vacuum control device 2 is provided with a relief valve control mechanism. When the vacuum control device 2 is mounted on the box body 1, the relief valve control mechanism can open or close the vacuum relief valve 11. Specifically, the relief valve control mechanism includes a top column 22 used to press the vacuum relief valve 11. The top column 22 can be controlled to move and press the vacuum relief valve 11. The relief valve control mechanism can be set to a column body through the vacuum control device 2. When pressing the column body, the pressure can be transferred to the vacuum relief valve 11, to deform the vacuum relief valve 11 to release the vacuum state. Referring to FIG. 4, FIG. 5 and FIG. 6, for facilitating operation, the relief valve control mechanism also includes a handle 21 that can control the top column 22; the handle 21 is hinged to the vacuum control device 2. One end of the top column 22 is connected to the handle 21 and the other end of the top column 22 is connected to the vacuum relief valve 11; pulling the handle 21 can control the movement of the top column 22, to press the vacuum relief valve 11.

Specifically, a driving mechanism 211 is arranged between the handle 21 and the top column 22 to convert the rotary motion of handle 21 to a linear motion of top column 22. The driving mechanism 211 can be set to a non-full-circular shape; when the handle 21 is rotated, the non-full-circular part can be abutted against and drive the top column 22; or a gear structure can be arranged in the place where the handle 21 is in contact with the top column 22, through the gear drive, it can also achieve the above functions. A spring 221 is connected between the handle 21 and top column 22. The top column 22 is snapped with the driving mechanism 211 via the spring 221, so that the top column 22 can be reset when the handle 21 is reset, to prevent the vacuum relief valve 11 is always pressed by the top column 22. The spring can also be arranged between the top column 22 and the box body 1; when the top column 22 is not pressed down by the handle, the spring will push the top column 22 far from the vacuum relief valve 11, to achieve the above functions. Specially, referring to FIG. 1, the vacuum control device 2 is provided with a groove that matches the shape of the shape of the handle 21. The handle 21 can be placed in the groove when it does not drive the top column 22 to press the vacuum relief valve 11. It is wholly aesthetic and uses will not touch the handle 21 mistakenly.

When a user wants to release the vacuum state in the box body 1, he can rotate the handle 21 (specifically, rotating to an angle of 90° with the vacuum control device 2) to press the top column 22 by the handle 21; the top column 22 will press the vacuum relief valve 11, and the air will enter the box body 1; when the handle 21 is placed to its original position, it can pull up the top column 22 through the action of spring 221 and the top column 22 will not press the vacuum relief valve 11 any longer and the box body is sealed. When a user takes away the vacuum control device 2, the vacuum relief valve 11 can be directly pressed to allow air into the box body 1.

In this embodiment, as shown in FIG. 7, the relief valve control mechanism is provided with an evacuation tube, which is the top column 22. A through-hole 222 is provided in the axial direction of the top column 22, to become an evacuation tube. The through-hole 222 is connected to the vacuum pump 24 through an air tube (not shown in the figure). When the vacuum control device 2 is mounted in the box body 1, the top column 22 is in contact with the vacuum relief valve 11, and the handle 21 is in a non-pulled state, at this time, the vacuum relief valve 11 is in a state of sealing the air intake of the box body 1; the through-hole 222 of the top column 22 is connected to the vacuumizing channel of the vacuum relief valve 11, when the vacuum pump 24 is started, the vacuum pump 24 works to reduce the pressure of the through-hole 222; when the pressure of the through-hole 222 reduces to less than the air pressure in the box body 1, the check valve 111 is opened and the air in the box body 1 is pumped out, to achieve the pumping of box body 1. In this embodiment, the vacuum relief valve 11 coordinates with the top column 22; the vacuum relief valve 11 may be used as the sealing member or a suction hole, and the top column 22 as a part for releasing the sealing or as an evacuation tube; the coordination between the two parts achieve the functions of both vacuumizing and releasing vacuum.

In this embodiment, the vacuum control device 2 is also provided with a control assembly. When the relief valve control mechanism opens the vacuum relief valve 11, the control assembly can make the vacuum pump 24 to stop working. Specifically, as shown in FIG. 4 and FIG. 6, the control assembly is specifically a switch control structure 212 provided on the relief valve control mechanism and a trigger switch 23 connected to the circuit (the wires are not shown in the figure) of the vacuum pump 24. The working principle of the switch control structure 212 is similar to that of the driving mechanism 211. When the relief valve control mechanism opens the vacuum relief valve 11 (namely, the handle 21 rotates 90°), it drives the switch control structure 212 to move, to trigger the trigger switch 23 to disconnect the circuit of the vacuum pump 2. The purpose of the control assembly: when a user rotates the handle 21, that is to release the vacuum, the vacuum pump 24 should be in a stopped state; when the control assembly is provided, rotating the handle 21 can achieve two purposes: pressing the e vacuum relief valve 11 to work, and disconnecting the circuit, without the addition of a new switch.

To sum up, the easily-operated vacuum storage container in the invention can easily release the vacuum state, facilitating users to use them.

It should be noted that the above preferred embodiments are used for description rather than restriction on the invention. Although detailed description has been made, technicians skilled in the art can modify the technical solutions or make equivalent replacements of some technical features herein; however, any modification, equivalent replacement and improvement within the sprint and principle of the invention shall still fall within the protection scope of the invention.

What is claimed is:

1. An easily-operated vacuum storage container comprising:

a box body and a vacuum control device that is mounted on the box body in a removable manner;

the vacuum control device comprising a vacuum pump for evacuating the box body;

the box body comprising a vacuum relief valve;

the vacuum control device comprising a relief valve control mechanism that can open or close the vacuum relief valve;

the relief valve control mechanism comprising a top column that can be controlled to move and press the vacuum relief valve;

the relief valve control mechanism comprising a handle that controls the movement of the top column;

the handle being hinged to the vacuum control device; and the handle driving the top column to move when the handle is pulled.

2. The easily-operated vacuum storage container according to claim 1 comprising:

the vacuum control device comprising a groove that matches the shape of the handle; and the handle being placed in the groove.

3. The easily-operated vacuum storage container according to claim 1 comprising:

a driving mechanism;

the driving mechanism being provided between the handle and the top column; and when the handle is pulled, the driving mechanism drives the top column to move.

4. The easily-operated vacuum storage container according to claim 1 comprising:

the top column being connected with a spring.

5. The easily-operated vacuum storage container according to claim 1, comprising:

the vacuum control device comprising a control assembly; and when the relief valve control mechanism opens the vacuum relief valve, the control assembly controls the vacuum pump to stop pumping.

6. The easily-operated vacuum storage container according to claim 5 comprising:

the control assembly comprising a switch control structure provided on the relief valve control mechanism and a trigger switch connected to a circuit of the vacuum pump; and when the relief valve control mechanism opens the vacuum relief valve, the switch control structure is driven to move, and the trigger switch is triggered to disconnect the circuit of the vacuum pump.

7. The easily-operated vacuum storage container according to claim 1 comprising:

the vacuum relief valve comprising a vacuumizing channel;

the vacuumizing channel being connected to the vacuum control device;

the vacuumizing channel comprising a check valve;

the vacuum pump being connected to the vacuumizing channel; and the check valve being opened when the vacuum pump is pumped.

8. The easily-operated vacuum storage container according to claim 7 comprising:

the top column being used to open or close the vacuum relief valve;

the top column being hollow so as to form an evacuation tube; and the vacuum control device being connected to the vacuum pump and the vacuumizing channel via the evacuation tube.

* * * * *